US005881908A

United States Patent [19]

Hays et al.

[11] Patent Number: 5,881,908

[45] Date of Patent: Mar. 16, 1999

[54] INSULATED SHIPPING CONTAINER FOR FISH

[75] Inventors: J. Michael Hays, Federal Way; Sam K. Ammar, Seattle, both of Wash.

[73] Assignee: Premier Industries, Inc., Tacoma, Wash.

[21] Appl. No.: 820,460

[22] Filed: Mar. 17, 1997

[51] Int. Cl.[6] ..... B65D 1/00

[52] U.S. Cl. ..... 220/669; 220/675; 220/902

[58] Field of Search ..... 220/675, 669, 220/902; 206/511

[56] References Cited

U.S. PATENT DOCUMENTS

| | | | |
|---|---|---|---|
| 3,103,278 | 9/1963 | Kuzma et al. | 220/902 X |
| 3,406,855 | 10/1968 | McKechnie | 220/669 X |
| 3,491,913 | 1/1970 | Giraudet et al. | 220/902 X |
| 3,563,445 | 2/1971 | Clayton | 220/669 X |
| 3,659,585 | 5/1972 | Bay | 220/675 X |
| 3,741,433 | 6/1973 | Bentley et al. | 220/771 X |

FOREIGN PATENT DOCUMENTS 2079718 4/1994 Canada .

*Primary Examiner*—Steven M. Pollard

*Attorney, Agent, or Firm*—Christensen O'Connor Johnson & Kindness PLLC

[57] ABSTRACT

An insulated container (12) for carrying goods such as fish is provided. The insulated container (12) includes a cover (14) and an open-topped box (16). The box (16) includes a bottom (26), two end walls (22, 24), and two bowed side walls (18, 20). Fillets lie in the corners where the bowed side walls and bottom meet. Longitudinal drainage ribs (40) extend along the bottom (26) between transverse platforms (42, 44). Indentations (28, 30, 32, 34) formed on the outer surface of the bowed container (12) define regions for receiving straps. The indentations are aligned with transverse platforms (42, 44), which provide reinforcement. The top of the end walls and the side walls include lips that mate with a depression located about the periphery of the cover (14). Bottom depressions (56, 58) ease the lifting of the container. Protrusions (68) located in the upper surface of the cover (14) mate with depressions (70*a,* 70*b,* 70*c,* 70*d*) located in the bottom surface of the box (16) to prevent sidewise slipping when the containers are stacked one atop another in various ways.

7 Claims, 6 Drawing Sheets

INSULATED SHIPPING CONTAINER FOR FISH

FIELD OF THE INVENTION

This invention relates to shipping containers and, more particularly, to insulated shipping containers.

BACKGROUND OF THE INVENTION

Unique concerns are posed by the storage and transport of perishable goods, such as meat fish, produce, etc. These concerns have led to the development of containers specifically tailored to carry perishable goods. The nature of the containers depends on the transportation media. Cardboard cases are commercially used when the transportation media is refrigerated, i.e., when the transportation media is a refrigerated truck or railroad car. Better insulated containers are used when the storage medium is not refrigerated. In order to keep weight low, such containers are often formed of expanded cellular polystyrene, i.e., Styrofoam.

In the past, insulated shipping containers have been generically shaped. The generic shape has taken the form of a right rectangular parallelepiped. Such containers comprise an open-topped box and a cover. The open-topped box includes a bottom, side walls and end walls that are integral with one another and define a right rectangular parallelepiped. The open-topped box is closed by a cover that is affixed to the box by straps, tape, etc. While right rectangular parallelepiped containers are suitable for use with some perishable goods, such as produce and cut meat, they have disadvantages when used with other products, such as gutted large fish, such as salmon.

Typically a refrigerant material, such as ice, is housed in an insulated container with the perishable goods being shipped. In the case of large fish, the fish are laid on their side and the ice is packed in and around the fish. Because fish do not have a right rectangular parallelepiped shape, the amount of ice packed into the corners of prior art insulated containers is greater than the amount of ice packed around the mid-section of the fish. Further, as the ice melts, it tends to gravitate to the corners. Both the initial corner concentration and the gravitation of ice to the corners of a container can create an undesirable temperature differential that results in cooler corners and a warmer center, where the major portion of the fish resides. Under extreme conditions this can result in fish spoilage.

Prior art insulated containers used to ship fish have other disadvantages. They are weaker than desired in several areas, particularly where the side walls and end walls meet the bottom. Further, they do not provide reinforcement for opposing the force produced by straps or other cover affixing mechanisms. In addition, the drainage mechanism used to keep fish above melted ice water is more complex than desired. Also, the bottoms and tops of such containers are flat, which allows them to slide with respect to one another when stacked one atop another. See, for example, the shipping container described in Canadian Patent 2,079,718. Further, the length and width dimensions of some prior art fish shipping containers results in overhangs at the corners when the containers are stacked on a pallet. Again, see Canadian Patent 2,079,718, particularly FIGS. 5, 6, and 7 and the related description.

The present invention is directed to providing an insulated shipping container for fish that overcomes the foregoing and other disadvantages of previously developed insulated containers.

SUMMARY OF THE INVENTION

In accordance with this invention, an insulated container having bowed side walls is provided. More specifically, the insulated container includes an open-topped box formed of a lightweight insulating material and a mating cover. The open-topped box includes a bottom, two end walls, and two bowed side walls integrally joined together.

In accordance with other aspects of this invention, integral fillets are located where the end walls and side walls meet the bottom of the open-topped box.

In accordance with further aspects of this invention, the inside surface of the bottom of the open-topped box includes longitudinal ribs.

In accordance with other further aspects of this invention, a pair of strap-defining indentations are formed on the outer surface of the insulated container, near the ends thereof. In accordance with yet other aspects of this invention, the inside surface of the container bottom has reinforcement saddles aligned with the strap-defining pairs of indentations.

In accordance with yet still other aspects of this invention, the bottom and top of the containers include protrusions and depressions that are designed to mate in a manner that prevents the sliding of one container with respect to another container when the containers are stacked one atop another in various ways.

In accordance with yet further other aspects of this invention, the upper edge of the box of the container includes an upwardly protruding inner lip and the cover includes a corresponding peripheral indentation.

In accordance with further aspects of this invention, the length and width dimensions of the container are such that the containers can be stacked on a pallet or other horizontal support in a manner that substantially eliminates overhangs.

As will be readily appreciated from the foregoing summary, the invention provides a new and improved insulated container ideally suited for shipping fish. The container is ideally suited for shipping fish because the bowed side walls conform more closely to the shape of a large fish than do the parallel side walls of prior art right rectangular parallelepiped insulated containers. The more equal distance between fish and the bowed side walls makes the uniform distribution of ice more uniform and thereby helps to maintain the freshness and quality of fish stored in the container. The integral fillets and the saddles add to the structural strength of the container while the ribbed bottom assists in preventing fish from lying in water as ice melts. The lip indentation interface between the cover and the box that form the container allows the cover to be easily aligned with the box in a durable manner. The mating protrusions and depressions assist in preventing sidewise sliding when the containers are stacked one atop another. The length and width dimensions create a stronger stack when the containers are stacked atop a pallet or other horizontal support. Hence, the invention overcomes many of the disadvantages of prior art insulated containers used to ship fish.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
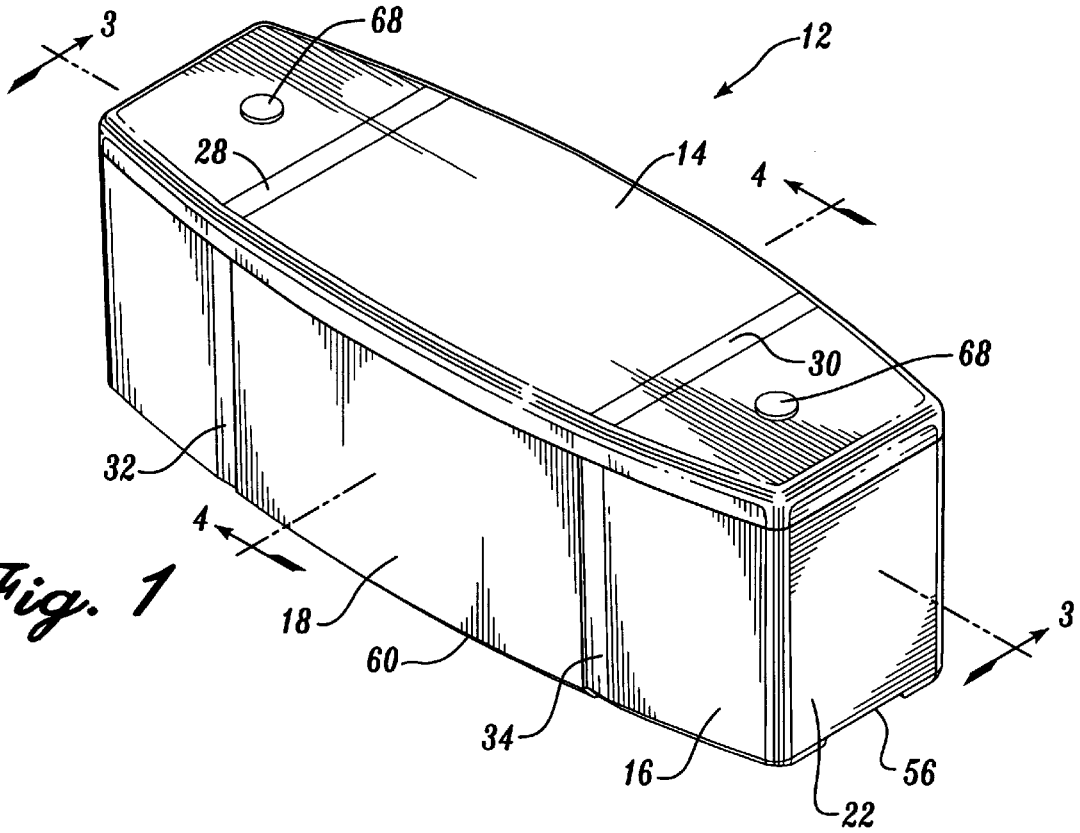
FIG. 1 is an isometric view of an insulated shipping container formed in accordance with the invention.
Figure 2:
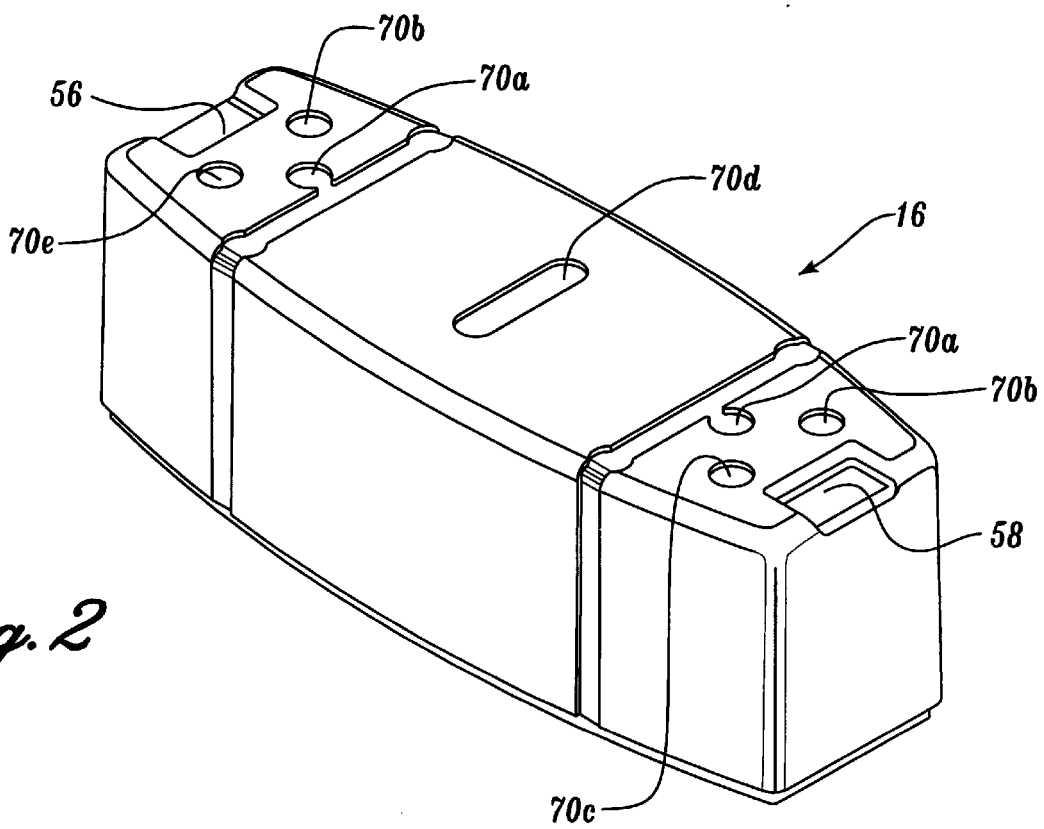
FIG. 2 is an isometric view showing the bottom of the box part of the container shown in FIG. 1.

FIG. 1 illustrates an insulated shipping container 12 formed in accordance with this invention. The container 12 is ideally suited for carrying perishable items, particularly fish. The container 12 is preferably made of expanded cellular polystyrene, i.e., Styrofoam. If desired, the container can be formed of other lightweight, suitably rigid insulating materials.

The container 12 includes a cover 14 and an open-topped box 16. As shown in FIGS. 1–4, the box 16 includes two bowed side walls, 18, 20, two end walls 22, 24, and a bottom 26. The box, i.e., the bowed side walls, end walls and bottom, is molded as an integral piece. The bowed side walls bow outwardly at the center. As a result, the space between the side walls is greater at the center than at the ends of the side walls. The curvature is generally constant and in only one plane—the horizontal plane. In essence, the side walls 18, 20 are mirror images of one another. The end walls 22, 24 are substantially flat, equally dimensioned, rectangular walls.

The inside surface of the bottom 26 of the open-topped box 16 includes a plurality of longitudinal ribs 40 that extend between a pair of transverse platforms 42, 44. The ribs 40, which have a generally sinusoidal shape when viewed in cross section create drainage grooves that separate melted ice from fish lying atop the ribs. The ribs are integral with the bottom 26.

The transverse platforms 42, 44 are raised platforms integrally formed on the inside of the bottom 26. The transverse platforms 42, 44 are located symmetrically, one on each end of the ribs 40. The transverse platforms 42, 44 have longitudinal axes that lie orthogonal to the longitudinal axes of the ribs 40. The transverse platforms 42, 44 extend longitudinally across the entire width of the bottom 26 of the container 12. Thus, the transverse platforms abut the bowed side walls 18, 20.

Rather than the bowed side walls 18, 20 making sharp interior corners with the bottom 26, preferably, each side wall/bottom and each end wall/side wall junction includes a fillet. That is, a fillet is located in the corners between the bowed side walls 18, 20 and the bottom 26 and between the side walls and the end walls. The fillets strengthen the corners of the open-topped box 16. The fillets 39 between the bottom 26 and the side walls 18, 20, particularly in the region of the ribs 40, are relatively large and, thus, strong. Further, preferably, the outside of the corners where the bowed side walls, end walls, and bottom meet are rounded, rather than sharp.

Figure 3:
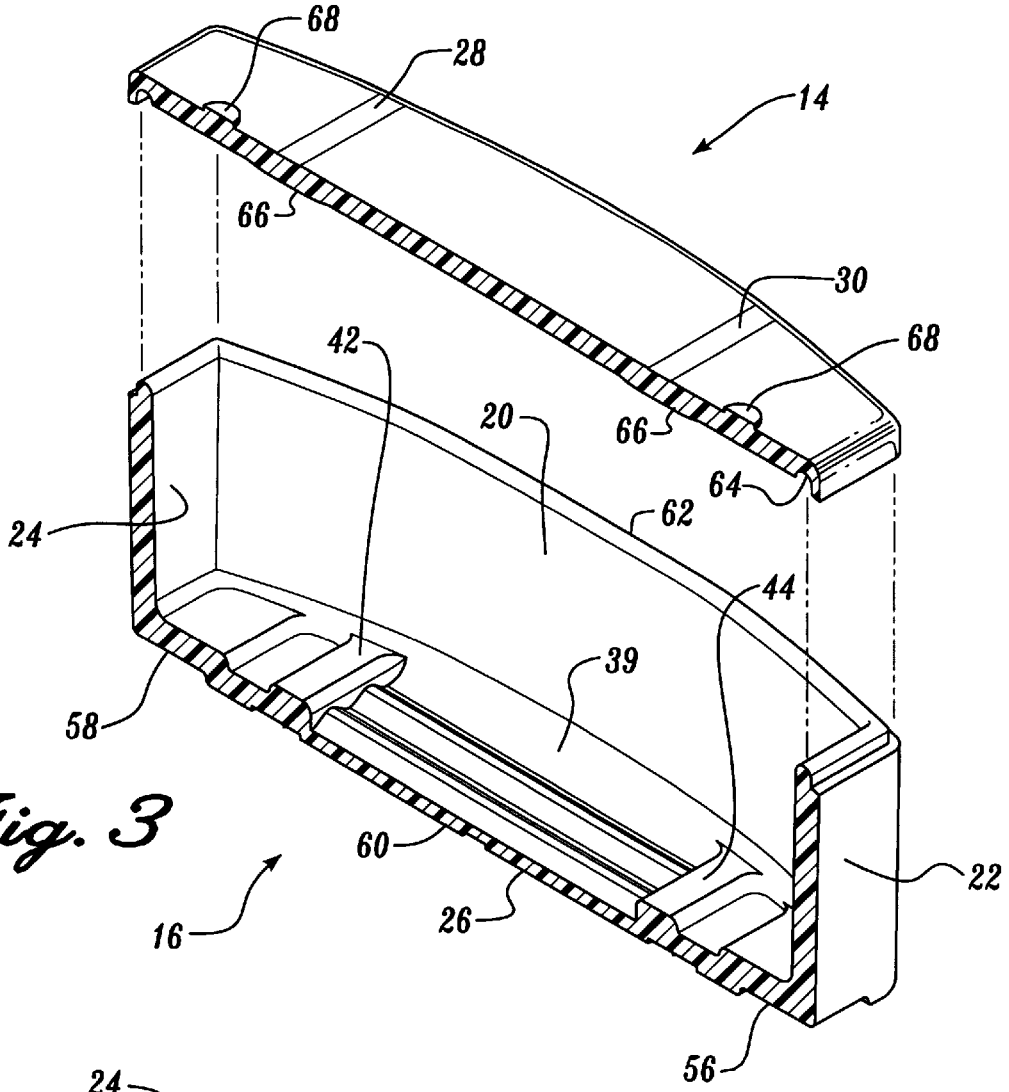
FIG. 3 is an exploded cross-sectional view along line 3—3 of FIG. 1.

As best shown in FIG. 3, preferably, the outer surface of the bottom 26 of the box 16 includes generally rectangular, inwardly extending depressions 56, 58, one located at either end. The outer surface of the bottom 26 between the depressions forms a plateau 60 on which the container 12 rests. The depressions 56, 58 provide gripping surfaces that facilitate carrying by allowing a carrier to slide his or her fingers under a container resting on the bottom plateau.

Figure 4:
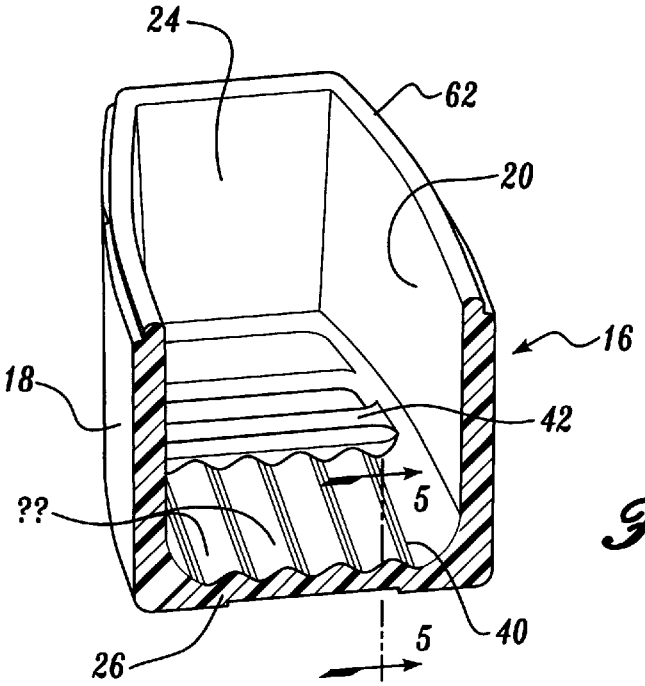
FIG. 4 is a cross-sectional view along line 4—4 of FIG. 1 of just the box part of the container.

The upper edge 36 of the bowed side walls 18, 20 and the end walls 22, 24 of the box 16 receive the cover 14. Rather than being flat, as best shown in FIGS. 3 and 4, the upper edge of the bowed side walls and the end walls include an integral, relatively thick inner lip 62. The inner lip 62 extends vertically upwardly from the inner surface of the side walls and the ends walls and then curves outwardly and downwardly until it merges with the top of the respective side and end walls 18, 20, 22, 24. Thus, a small ledge extends around the top of the side walls 18, 20 and the end walls 22, 24. The perimeter of the cover 14 includes a depression 64 that mates with the inner lip 62.

Figure 5:
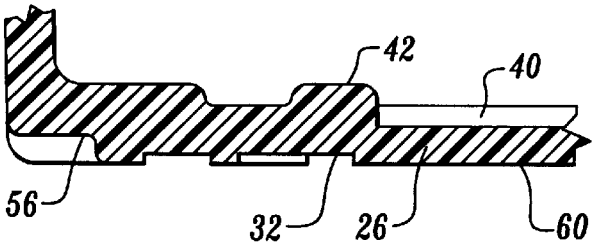
FIG. 5 is a fragmentary cross-sectional view along line 5—5 of FIG. 4.

Located in alignment with each other on both the cover 14 and the box 16 are a pair of strap-defining indentations 28, 30, 32 and 34. The cover indentations 28, 30 span the width of the top of the cover 14, and the box indentations 32, 34 circumscribe the outside of the bowed side walls 18, 20 and the bottom 26 of the box 16. The cover indentations are aligned with thicker regions 66 of the cover 12. Further, as best seen in FIG. 5, the box indentations are aligned with the transverse platforms 42, 44. Preferably, the pair of indentations are sufficiently wide for a strap (not shown) to be placed in the indentations. The thicker regions 66 and the transverse platforms 42, 44 provide reinforcement when straps are applied and tightened. Obviously, if desired, additional indentations can be provided to accommodate additional straps—or, only a single indentation provided for receipt of a single strap.

Formed in the upper surface of the cover 12 are two upwardly extending cylindrical protrusions 68. The cylindrical protrusions lie along the longitudinal axis of the cover 12, two on one side of the cover and two on the other side, between the strap indentations 28, 30 and the ends of the cover 12.

Figure 6:
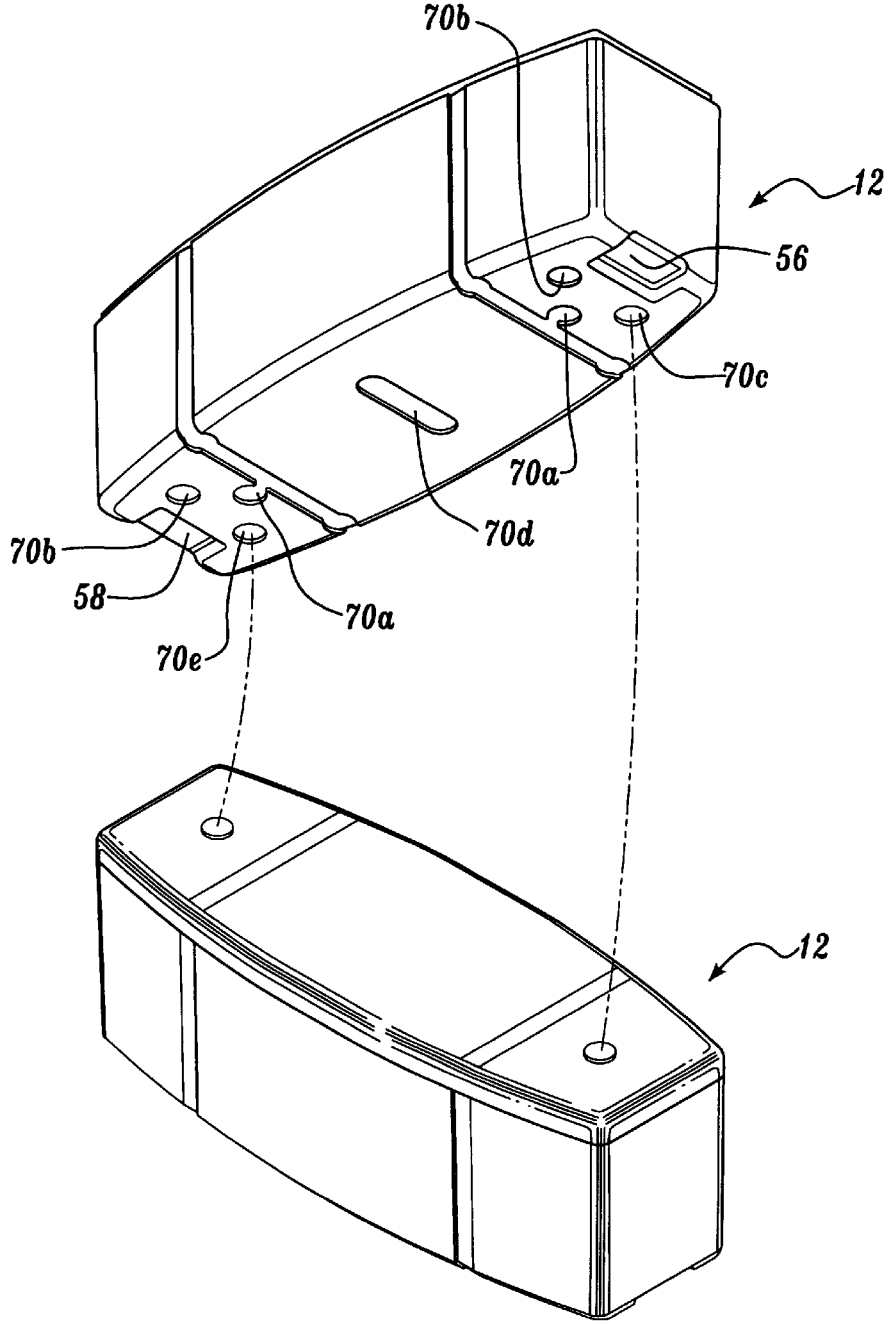
FIG. 6 is a pictorial view of two containers of the type shown in FIG. 2 illustrating how they interlock when stacked.
Figure 7:
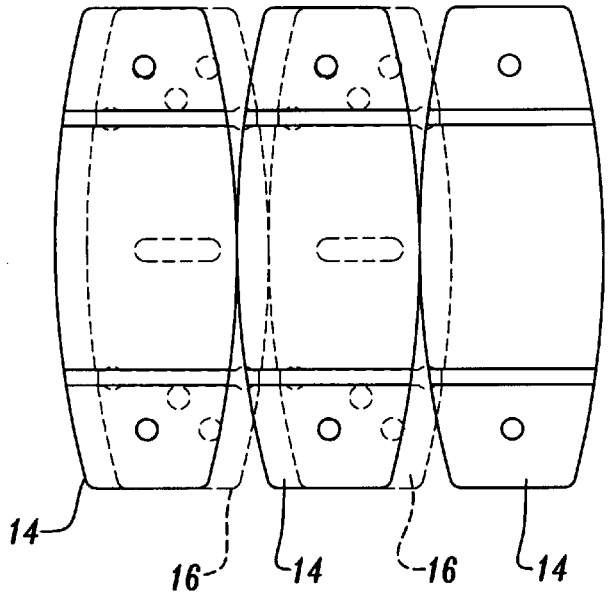
FIG. 7 is a top plan view showing several containers stacked using the interlock arrangement shown in FIG. 6.

Located in the plateau 60 in the bottom of the box 16 are three cylindrical depressions 70*a*, 70*b*, 70*c*, located at each end of the bottom. Two of the cylindrical depressions 70*b* and 70*c* are aligned with and sized to receive the upwardly extending cylindrical protrusions of a container cover located beneath and suitably aligned with the bottom of a box 16. More specifically, as shown in FIGS. 6 and 7, when containers formed in accordance with this invention are stacked in longitudinal alignment one atop another and slightly offset, they are prevented from slipping sidewise by the cylindrical protrusions 68 of the underlying cover 14 mating with the aligned cylindrical depressions 70*b* or 70*c* of the overlying box 16.

In addition to the three aligned cylindrical depressions 70*a*, the plateau 60 also includes an elongate center depression 70*d*. The depressions are used to create a secure stack when the containers 12 are stacked in a suitable manner, such as shown in FIGS. 8, 9, 10, and 11.

Figure 8:
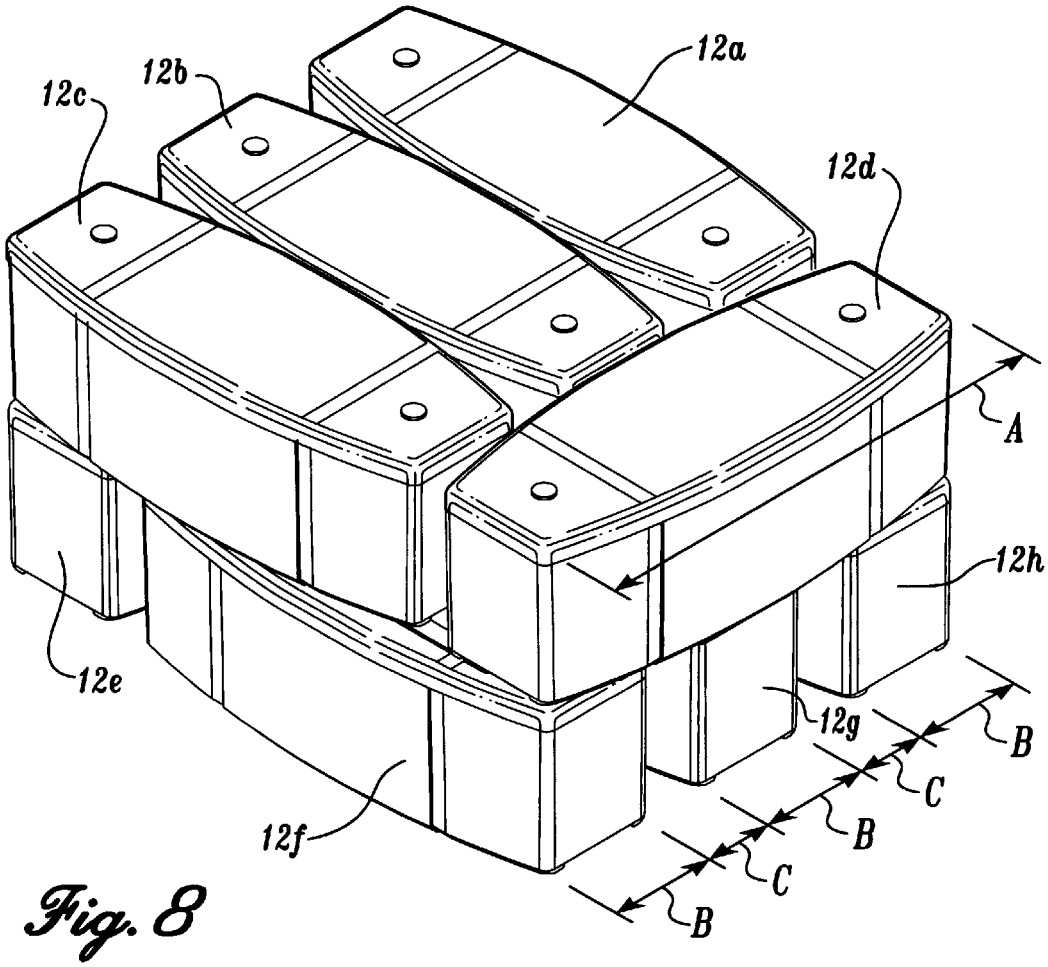
FIG. 8 is an isometric view showing how containers formed in accordance with the invention can be stacked in a manner that eliminates overhangs.
Figure 9:
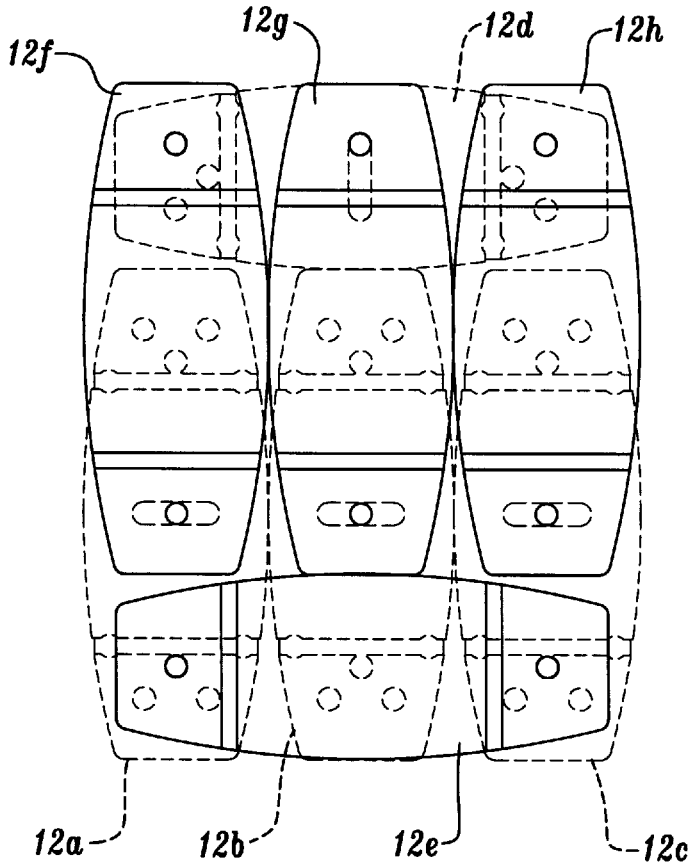
FIG. 9 is a plan view of the stack shown in FIG. 8, the top layer being shown in phantom.

FIGS. 8 and 9 illustrates how a plurality of containers 12*a*, 12*b*, 12*c*, 12*d*, . . . formed in accordance with this invention can be stacked on a horizontal surface, such as a pallet (not shown), in a way that substantially eliminates corner overhang. In this regard, the length and width dimensions of the container must be such that the length of the containers (A) equals the width of three end walls (B), plus twice the space (C) between the end walls when the longitudinal axes of the containers are parallel to one another and the bowed sides are touching. The space (C) between the end walls is the same as the difference between the width of the end walls (B) and the maximum width between the side walls, i.e., the width of the side walls at the maximum bow point. As shown in FIG. 7, this dimensional relationship allows the containers to be stacked four to a layer—three containers lying parallel to one another and the fourth lying cross-wise at one end of the three containers. Each layer is rotated by 180° with respect to the above and below layers. In one actual embodiment of the invention, the length of the containers is approximately 34.25 inches, the width of the end walls is approximately 8.75 inches, the maximum distance between the side walls, which occurs at the center of the bow, is approximately 12.75 inches, and the height of the containers, including the cover, is approximately 12.5 inches. Thus, the spacing between the end walls, when two containers lie side by side with their longitudinal axes parallel, is approximately 4.0 inches.

Figure 10:
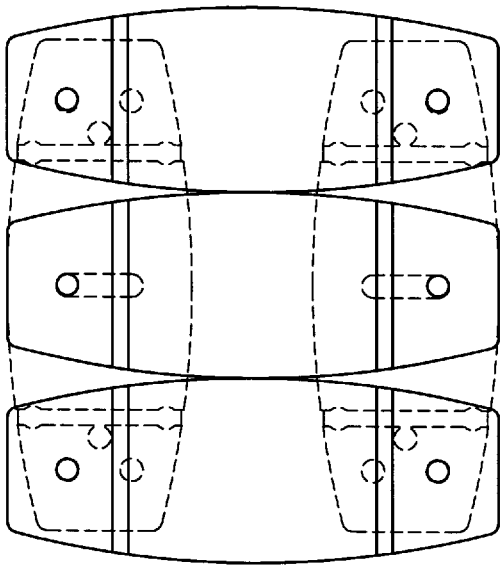
FIG. 10 is a plan view of another interlocking stacking arrangement.
Figure 11:
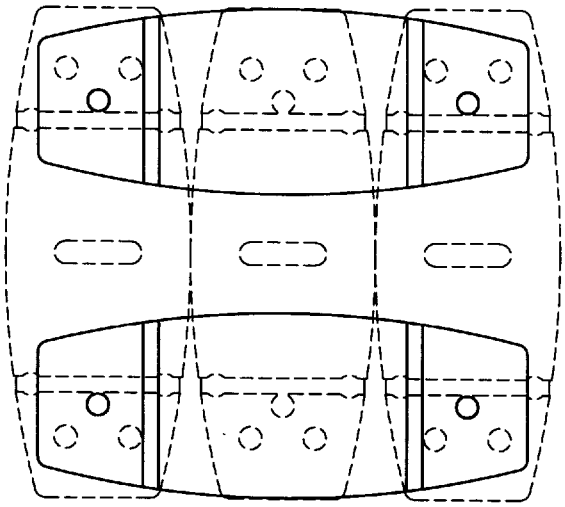
FIG. 11 is a plan view of yet another interlocking stacking arrangement.

FIGS. 10 and 11 illustrate other interlocking stacking arrangements. Other interlocking stacking arrangements are also possible.

While the presently preferred embodiment of the invention has been illustrated and described, it is to be understood that, within the scope of appended claims, various changes can be made therein without departing from the spirit of the invention.

The embodiments of the invention in which an exclusive property or privilege is claimed are defined as follows:

1. An insulated shipping container, comprising:

(a) an open-topped box formed of a lightweight insulating material, said box including:

a bottom;

two end walls integral with said bottom and located at opposite ends of said bottom; and two bowed side walls integral with said bottom and said end walls located along opposite side edges of said bottom, between said end walls, said bowed side walls bowing outwardly from one another, wherein (i) the height of said two end walls and the height of said two bowed side walls is substantially less than the distance between said two end walls;

(ii) the inside surface of said bottom includes integral, longitudinally extending elongate ribs; and (iii) the inside surface of said bottom also includes two integral platforms lying transverse to said longitudinally extending elongate ribs, one platform located at one end of said ribs and the other platform located at the other end of said ribs;

(b) a cover formed of a lightweight insulating material sized and configured to mate with the upper edges of said two end walls and said two bowed side walls; and (c) two strap indentations encircling the outer surface of said bowed container, one of said strap indentations aligned with one of said platforms and the other of said strap indentations aligned with the other of said platforms.

2. The insulated shipping container claimed in claim 1, further comprising fillets in the corners where said bowed side walls meet said bottom.

3. The insulated shipping container claimed in claim 2, wherein the outer ends of the bottom of said box include lifting depressions.

4. The insulated shipping container claimed in claim 3, wherein the upper edge of the end walls and the bowed side walls of said box include a lip and wherein the periphery of said cover has a corresponding depression.

5. The insulated shipping container claimed in claim 4, wherein the upper surface of the cover and the lower surface of the box contain protrusions and depressions sized and positioned such that protrusions and depressions mate with one another and prevent sidewise slipping when one container is stacked on another container.

6. The insulated shipping container claimed in claim 5, wherein the upper surface of said cover contains said protrusions and the lower surface of said box contains said depressions.

7. The insulated shipping container claimed in claim 6, wherein the length of the containers is equal to the width of three end walls, plus twice the difference between the width of an end wall and the maximum width between the bowed side walls.

* * * * *

UNITED STATES PATENT AND TRADEMARK OFFICE

CERTIFICATE OF CORRECTION

PATENT NO. : 5,881,908

DATED : March 16, 1999

INVENTOR(S) : J.M. Hays et al.

It is certified that error appears in the above-identified patent and that said Letters Patent is hereby corrected as shown below:

| COLUMN | LINE | |
|---|---|---|
| [56] Pg. 1, col. 1 | Refs. Cited (Foreign Patents) | in the Foreign Patent section, insert the following references: |

| | | |
|---|---|---|
| --998,973 | 10/1976 | Canada |
| 2,199,269 | 3/1996 | Canada |
| 2,207,445 | 6/1996 | Canada-- |

Signed and Sealed this

Fourteenth Day of September, 1999

*Attest:*

Q. TODD DICKINSON

*Attesting Officer*

*Acting Commissioner of Patents and Trademarks*